United States Patent [19]

Dibble

[11] Patent Number: 4,915,452

[45] Date of Patent: Apr. 10, 1990

[54] HYDRAULIC BOREHOLE MINING SYSTEM AND METHOD

[76] Inventor: Merton F. Dibble, 5908 Oakmont La., Lakeland, Fla. 33803

[21] Appl. No.: 339,136

[22] Filed: Apr. 17, 1989

[51] Int. Cl.[4] ..... E21C 45/00

[52] U.S. Cl. ..... 299/17; 175/67; 175/216

[58] Field of Search ..... 299/16, 17, 64; 175/213, 214, 215, 216, 67; 166/72, 369, 371

[56] References Cited

U.S. PATENT DOCUMENTS

| | | | |
|---|---|---|---|
| 3,439,953 | 4/1969 | Pfefferle | 175/67 X |
| 3,747,696 | 7/1973 | Wenneborg et al. | 175/87 |
| 3,749,314 | 7/1973 | Robinson et al. | 239/206 |
| 3,797,590 | 3/1974 | Archibald et al. | 175/213 |
| 4,059,166 | 11/1977 | Bunnelle et al. | 175/232 |
| 4,401,345 | 8/1983 | Archibald | 299/64 |
| 4,575,155 | 3/1986 | Hodges | 299/17 |

FOREIGN PATENT DOCUMENTS

| | | | |
|---|---|---|---|
| 0972099 | 11/1982 | U.S.S.R. | 299/16 |
| 1113549 | 9/1984 | U.S.S.R. | 299/17 |

OTHER PUBLICATIONS

Hrabik, J. et al., Economic Evaluation of Borehole Mining Systems in Phosphate Deposits, U.S. Dept. of Interior, Info. Cir. 8929, pp. 3–9, 1983.

Savanick, G. A., *Borehole Mining of Deep Phosphate Ore in St. John County Fla.,* Feb. 1985, pp. 144–148.

"Small Diameter Pumps for In Situ Leaching", Technology News, Bureau of Mines, U.S. Dept. of Interior, No. 192, Feb. 1984.

Savanick, G., *Society of Mining Engineers of AIME,* Bureau of Mines, U.S. Dept. of Interior, Reprint No. 79–53, 2/1979.

Dibble, M. F., *Borehole Slurry Extraction of Phosphate,* Presented at Engineering Foundation Conference, Santa Barbara, Calif., Oct. 25–30, 1987.

*Primary Examiner*—Jerome W. Massie
*Assistant Examiner*—David J. Bagnell
*Attorney, Agent, or Firm*—Warren L. Franz

[57] ABSTRACT

A hydraulic borehole mining system has a cutting jet nozzle supported on an insert short length of tubing of a cutting jet head within a water supply conduit in the lowest section of a multi-conduit pipe string that extends from the surface through a borehole to a target zone to be mined. A rod extending from the surface through the string outside of the water supply conduit connects to the head to reposition the nozzle vertically, independent of movement of the conduit or string. The borehole annulus is sealed and connected to a surface standpipe for development of a hydrostatic head pressure that acts, with or without downhole pump assistance, to raise the slurry created by the nozzle jet up through a second conduit in the pipe string. Material is pumped down the same second conduit after mining to backfill the hole.

20 Claims, 5 Drawing Sheets

HYDRAULIC BOREHOLE MINING SYSTEM AND METHOD

This invention relates to improvements in underground mining; and, in particular, to improvements in hydraulic borehole mining using novel cutting jet nozzle manipulation and slurry extraction techniques.

BACKGROUND OF THE INVENTION

Borehole mining of the type to which the present invention relates involves the creation of a slurry of rock particles containing recoverable mineral values by impacting a selected mineral formation with water or other aqueous solution delivered at high pressure through a nozzle lowered into a borehole. The slurry is elevated to the surface where the valuable mineral constitute is separated from the waste material.

Hydraulic borehole mining systems have several inherent advantages over conventional mining systems. Principal among them is the ability to permit the extraction of material selectively. Such systems can extract minerals that are too deep for economical strip mining without causing surface disturbances. Also, borehole mining is a far more acceptable method from both an environmental and safety standpoint than either conventional strip (open pit) or underground mines.

Borehole mining has not developed to its full potential for several reasons. One of the more applicable minerals for extraction by a borehole system is phosphate rock. Historically, shallow, low cost, strip mines have supplied the bulk of the United States needs from Central Florida. There was no need to develop this technology, as low cost rock was available and land values were sufficiently low to tolerate large acreages being tied up in waste disposal areas and reclaimed pits. In addition, conventional borehole mining was a high energy consumer because of the inefficiency of lift pumps and friction losses encountered in the transport of sufficient volumes of water at high pressure through restricted pipe sizes to create slurries.

The depletion of the low cost Central Florida phosphate reserves, the environmental restrictions opposing the development of new strip mines, and appreciating land values now increases the importance of borehole mining technology. The United States has abundant resources of deep phosphate rock both on and offshore that cannot be mined by conventional open pit or dredging methods, but can be extracted by borehole mining.

An initial part of the hydraulic borehole mining process involves, first, the drilling of a hole from the surface through a favorable mineral horizon or target zone. The hole is normally cased above the mineral zone to prevent shallower unconsolidated non-target zone materials from clogging the hole. A multi-conduit pipe, carrying a high pressure discharge nozzle (known as a "cutting jet" nozzle), is then lowered into the hole below the casing to the depth of the target zone, and water is directed against the borehole walls with sufficient pressure to break or wash particles loose from their matrix and create a slurry of solids and water which can be brought to the surface by pumping.

Easy mobility of the cutting jet is of great economic impact to the mining process. Known borehole mining systems normally permit the jet to be rotated at least to some extent without moving the mining tool, but usually require removal of the tool string in order to reposition the jet vertically. It is beneficial for a borehole system to be able to control the vertical movement of the cutting jet independently of the location of the rest of the mining tool. The effectiveness of the slurry forming system is improved when the cutting jet nozzle can be moved in a vertical manner, as well as rotated, independently of location of the slurry pump collection point. This independence of movement will allow the nozzle to be used to create slurry from different elevations in the formation, while maintaining the collection site for this slurry at the lowest level of the cavity. Maintaining the collection point at the lowest level will maximize the productivity, as the percent solids of the slurry will be the highest at that level with the volume remaining the same.

One known approach for providing both rotational and vertical freedom of movement of the cutting jet independently of the remainder of the system is described in Archibald U.S. Pat. No. 4,401,345. The Archibald system mounted the cutting jet on a separate pipe, bolted together in 20-foot sections and inserted from the surface through a slot in the remainder of the mining tool after the usual mining tool main pipe sections were already in place. The main pipe was connected to the usual swivel and hoist, and the separate jet pipe was connected to its own separate water swivel which could be raised and lowered relative to the main swivel by a separate hoist. Although this system worked, it was inefficient because of the slot restriction imposed on the area available for transporting the cutting jet and the attendant small inside diameter allowed for the associated moving cutting jet water supply line.

Prior art methods for lifting the slurry to the surface include jet pumps (also called "eductors") and force pumps located in the lower portion of the borehole. The jet pumps circulate a supply of high pressure fluid from the surface to downhole and back to the surface again, drawing the slurry with it by means of a venturi effect. The force pumps are volume displacement pumps located downhole and connected to receive either hydraulic or electric motive power from the surface.

The use of mechanical force pumps downhole can greatly complicate the construction and operation of the mining tool. Lines must be run to provide electricity or hydraulic fluid from the surface. Such pumps are apt to break down and necessitate frequent servicing, which requires removal, repair and reinsertion of the mining head with consequent expense and lost time.

The eductor pump has been the principal choice, historically, for slurry retrieval because of its simplicity. Such a pump is very inefficient, however, as the lifting effect is by high pressure water pumped downhole from the surface and back up again. The eductor pump uses one of the conduits of the multi-conduit pipe. The water passes through a nozzle that is directed through a restricted orifice in the lowest mining tool section of the multi-conduit pipe string. The resulting reduced pressure functions in the manner of a venturi within the orifice to provide the lifting action necessary to elevate the slurry. Large quantities of high pressure water are required for the powering of the pump, resulting in dilution (reduction in percentage of solids) of the recovered slurry which may cause subsequent processing problems at the surface and thereby reduce the overall productivity of the system.

The efficiency of the eductor pump is improved for hydraulic mining that takes place in a flooded borehole cavity environment which provides a hydrostatic head at the slurry intake port equal to the head differential between the elevation of the natural water table and the point of intake. The energy required to lift the slurry solids to the surface is then only that needed to overcome the friction losses of the slurry flow path in the pipe plus the head differential between the water table and the slurry discharge elevations.

SUMMARY OF THE INVENTION

It is an object of the present invention to provide improvements in hydraulic borehole mining systems, especially in ore slurry formation and extraction.

It is another object of the invention to provide a hydraulic borehole mining system having an improved cutting jet nozzle arrangement, allowing the cutting jet to be raised and lowered independently of the cutting jet water supply conduit and the rest of the mining tool string.

It is a further object of the invention to provide a hydraulic borehole mining system having improved means for elevating a slurry in a flooded cavity, which minimizes the necessity for use of any downhole pump.

A hydraulic borehole mining system in accordance with the invention has a cutting jet nozzle supported for independent vertical movement on a cutting jet head within a lower section of a mining tool string of multi-conduit pipe depending from the surface of a borehole to a position adjacent an underground target zone of a formation to be mined. The head is placed in fluid communication with the pipe cutting jet water supply conduit, and small diameter means is provided extending through the string to permit the head to be selectively raised and lowered from the surface, independent of any repositioning of the conduit or the remainder of the string. In a preferred embodiment, described in detail below, the nozzle is mounted by means of a 90 degree elbow and a reducer to the bottom of a length of tubing received coaxially for movement within the lowest extreme of the jet water conduit of the string. Vertical movement of the head tubing is controlled by manipulation at the surface of a rod which extends through the tool string separate from the conduit and connects downhole in the lowest tool section to the nozzle.

In another aspect of the invention, a hydraulic borehole mining system in accordance with the invention has a mining tool string of multi-conduit pipe sections lowered through a sealed casing in a flooded borehole environment, and a surface-located standpipe having an internal cavity placed in fluid communication with the annulus between the cased borehole and the string. The pipe includes a slurry retrieval conduit extending to a swivel-located slurry discharge line from an intake port located downhole, and the internal cavity of the standpipe is sufficiently elevated to provide a hydrostatic head relative to the intake port, so that slurry formed downhole is driven up the slurry retrieval conduit with little or no requirement for a downhole pump.

The system of the invention is further designed so that material recovered by the slurry retrieval conduit in the mining tool pipe string can be thickened after removal of target minerals and returned for backfilling the hole by the same conduit. Using this approach, in thick mineral deposits, e.g., in excess of 30 feet, waste material can also be injected to the bottom of the cavity created, similar to backfilling in underground mines, without removing the mining tool sections. This allows mining to continue in a thick or in a series of mineral zones separated by barren noncommercial materials and will help maintain cavity floor stability using the same originally drilled hole.

BRIEF DESCRIPTION OF THE DRAWINGS

Embodiments of the invention have been chosen for purposes of illustration and description, and are shown in the drawings, in which.

Throughout the drawings, like elements are referred to by like numerals.

DETAILED DESCRIPTION OF PREFERRED EMBODIMENTS

Figure 1:
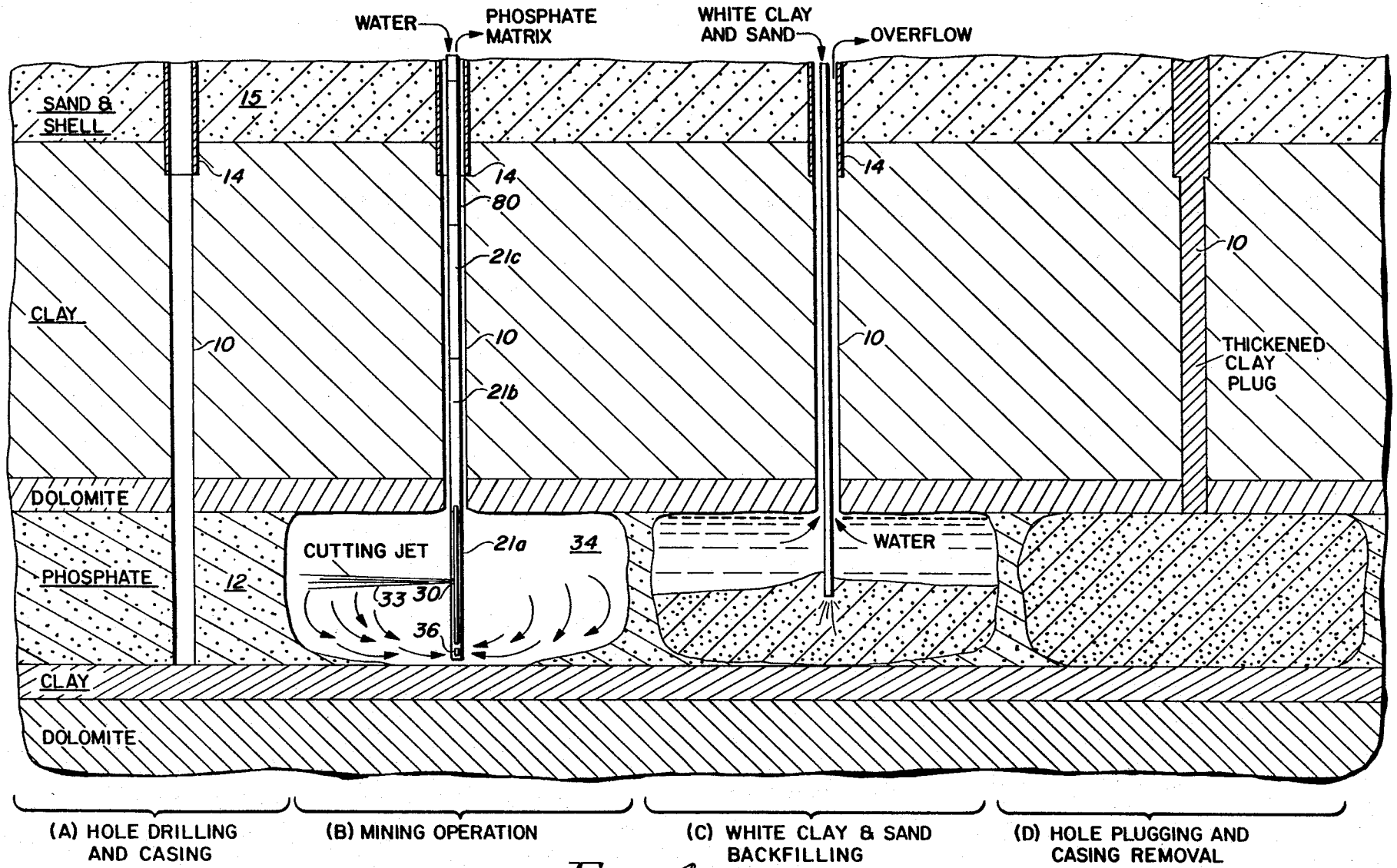
FIG. 1 is a schematic view showing the various steps A-D in the life cycle of a borehole employed in a hydraulic borehole mining system of the type to which the present invention relates.
Figure 2:
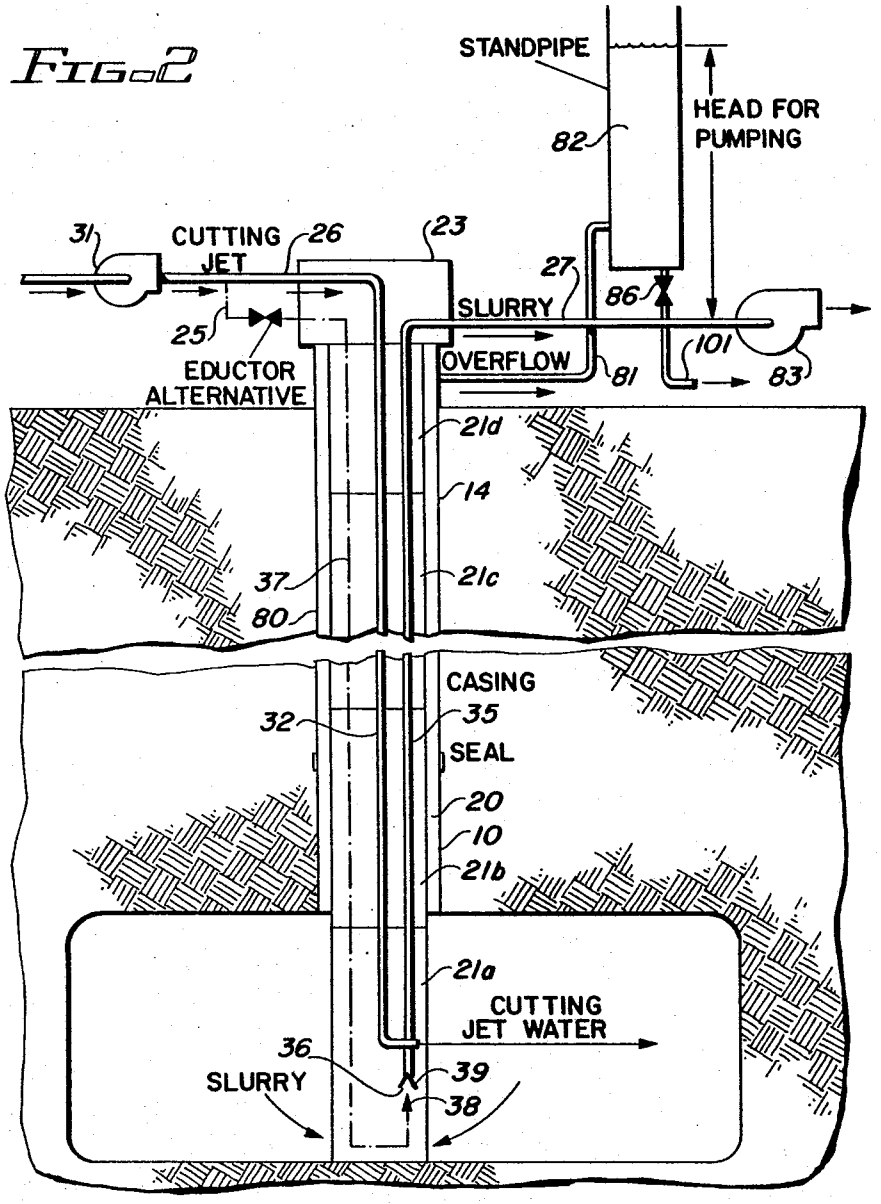
FIG. 2 is schematic view of mining tool and surface components usable in the borehole cutting and slurry extraction step of FIG. 1B in a mining system in accordance with the invention.

Implementations of the present invention are discussed, by way of illustration, with reference to a hydraulic borehole mining system for mining an unconsolidated phosphate ore formation utilizing a borehole and apparatus as shown schematically in FIGS. 1 and 2.

FIG. 1 shows the life cycle of a borehole of the type generated in the course of implementing the mining system of the present invention including initial establishment of the borehole by drilling and casing (FIG. 1A); conveying a mining tool string including a cutting jet into the hole to create an ore slurry which is retrieved to the surface for separation (FIG. 1B), backfilling the mined target zone cavity with waste material (FIG. 1C); and removing the casing and plugging the hole (FIG. 1D). These steps are discussed in terms of borehole mining operations, in accordance with the invention employed, for example, in a typical section of miocine Hawthorne formation for the recovery of phosphate in Central Florida.

As a preliminary step to the hydraulic borehole mining process, a borehole 10 is drilled to a depth of phosphate ore body at a target zone 12, and casing 14 is applied in known manner to depths short of the target zone 12 to prevent cave-in of unconsolidated overburden material 15 (FIG. 1A). If the overburden material is a consolidated material, the borehole may be left uncased. A mining rig (such as the mining trailer 16 shown in FIG. 3) is then positioned so that a hoist 17 having a hook 18 is located directly over the borehole 10, and the hoist 17 is used to lower a mining tool 20 into the borehole to a depth adjacent the target zone 12 below the casing 14 (FIG. 1B). The mining tool 20 is made up of plurality of multi-conduit pipe sections 21*a*, 21*b*, 21*c*, 21*d* (FIG. 2) connected end-to-end in series as in conventional systems, and has a length determined by the number of sections 21 which may be added and lowered by the hoist 17. The length of the tool string 20 is chosen so that the lowest section 21*a* of the tool 20 is near the bottom of the borehole 10.

Figure 6:
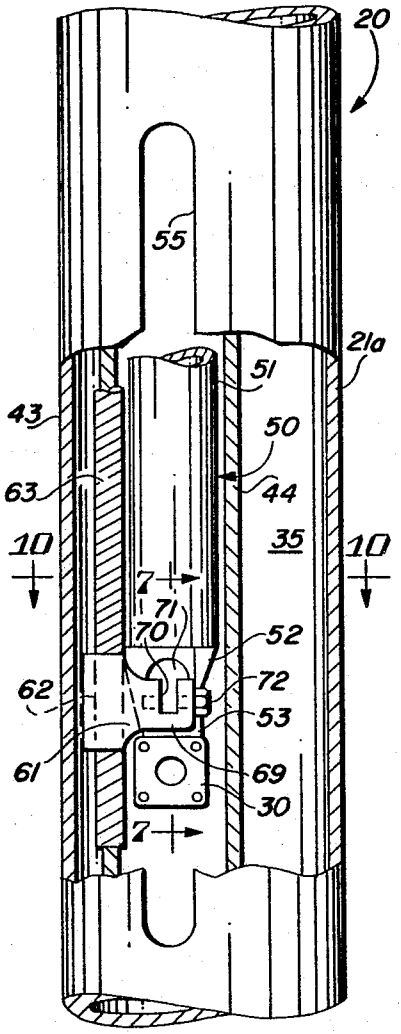
FIG. 6 is a cutaway view, partially in section, of the cutting of the mining tool of FIG. 2.
Figure 4:
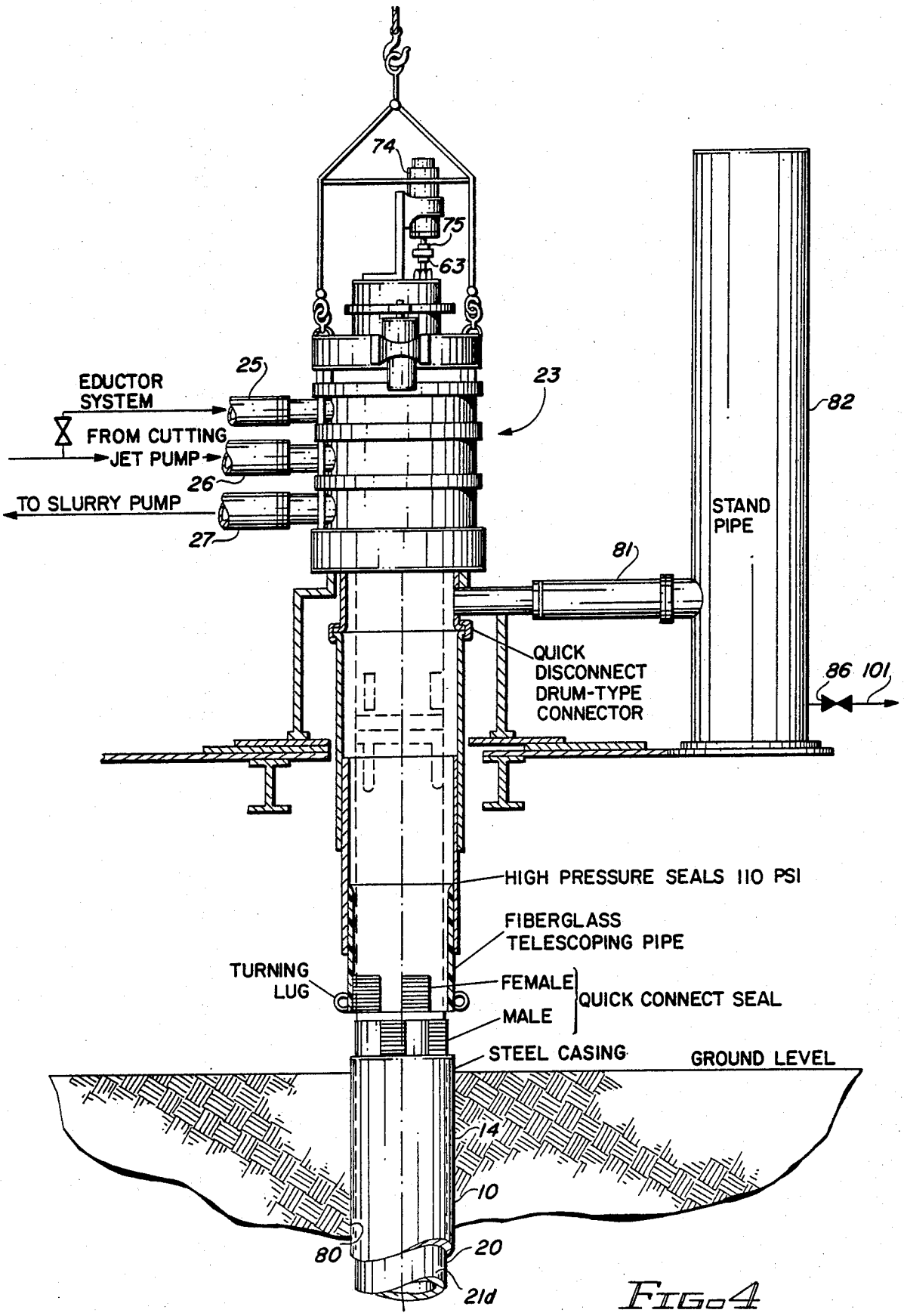
FIG. 4 is an enlarged view, partially in section showing the swivel and standpipe attachment of the mining tool of FIG. 2.
Figure 7:
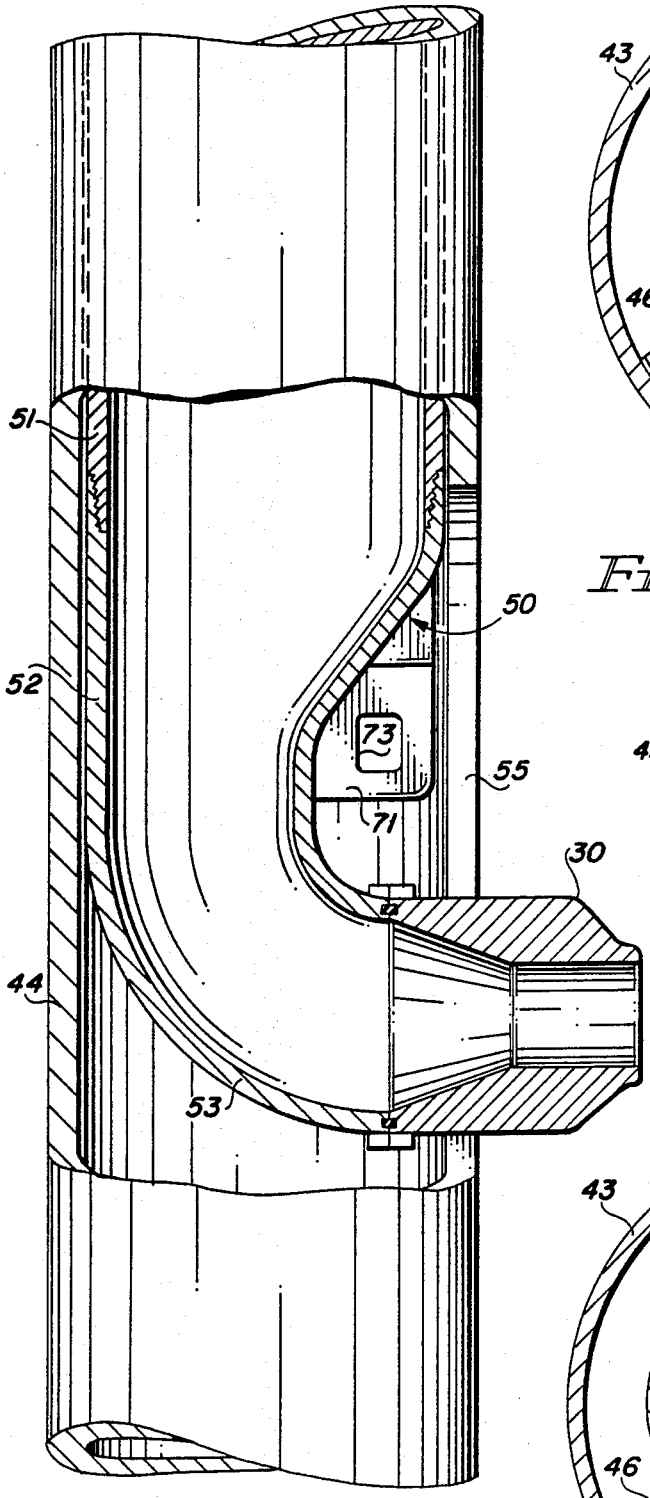
FIG. 7 section view taken along the line 7—7 of the cutting jet water supply conduit and cutting jet assembly components of FIG. 6.

A power swivel 23 (FIGS. 2–4) is attached to the uppermost section 21*d* of the mining tool 20 and hoses 25, 26, 27 are attached to the swivel 23 as shown in FIG. 4. A cutting jet nozzle 30 (FIGS. 1B, 6 and 7) carried on the bottom section 21*a* of tool 20 is positioned at a desired location facing the walls of the borehole 10 in the area of the target zone 12, so that water at high pressure from a main cutting jet pump 31 (FIGS. 2 and 3) can be delivered by the hose 26 through a water supply conduit 32 to the nozzle 30 with sufficient force so that a jet cutting stream 33 (FIG. 1B) issues to erode the ore body 12 to create an aqueous slurry 34 which may be pumped up through a slurry retrieval conduit 3 in the tool 20 from a slurry intake port 36 at the bottom of the tool 20 to the surface, for delivery by means of the slurry hose 27 for further processing.

The invention improves over conventional hydraulic borehole mining systems by providing novel means for arranging the cutting jet nozzle 30 so that it is movable, not only rotationally by means of the swivel 23, but also vertically independently of movement of the rest of the mining tool 20 and, unlike the arrangement shown in Archibald U.S. Pat. No. 4,401,345, without adversely affecting cutting jet water supply delivery through the main pipe conduit 32. The invention also provides novel means for retrieval of the slurry which can be used alone or in combination with conventional eductor slurry removal apparatus indicated by dot-dashed lines in FIG. 2. In the eductor system, high pressure water passing through a hose line 25 of swivel 23 (FIG. 4) and into an eductor water supply conduit 37 is delivered downhole to a discharge nozzle 38 opposite a fluid intake opening 39 at the lowest extremity of the slurry retrieval conduit 35 (FIG. 2), where a venturi action draws slurry upwardly with it to the slurry removal hose 27.

Figure 8:
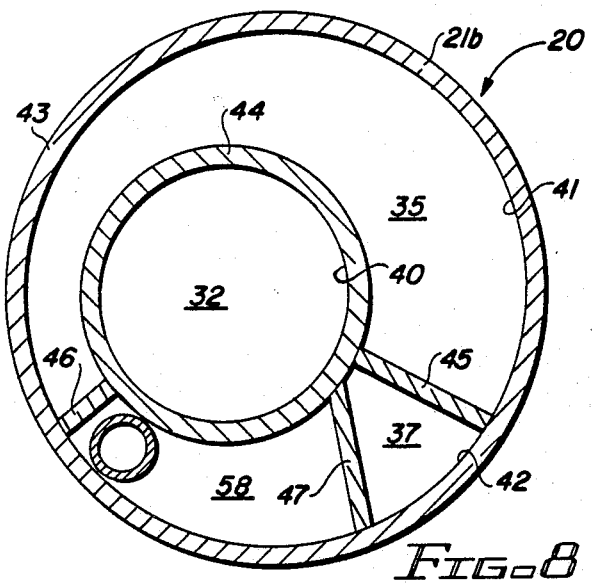
FIGS. 8–10 are section views taken along the lines 813 8, 9—9, and 10—10 respectively, of FIGS. 5 and 6.
Figure 9:
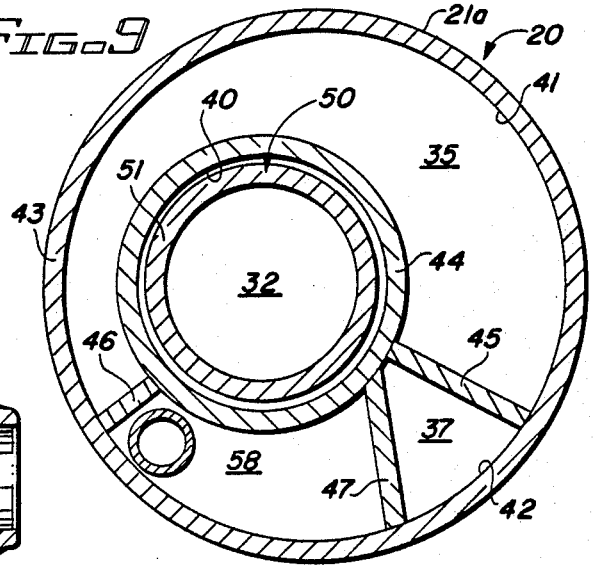
Figure 10:
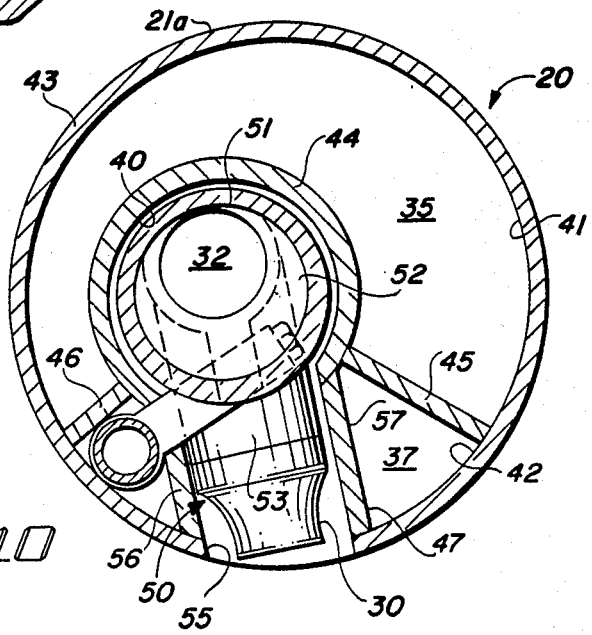

As shown in FIGS. 8–10, each section 21 of pipe of the mining tool 20 is a multi-conduit section, segmented into a cutting jet water supply conduit portion 40, a slurry retrieval conduit portion 41 and, where applicable, an eductor water supply conduit portion 42. The sections are connected together so that corresponding portions of adjacent pipe sections mate in sealed, fluid communicating relationship: The connected portions 40 establishing the cutting jet water supply conduit 32; the connected portions 41 establishing the slurry retrieval conduit 35; and the connected portions 42 establishing, where applicable, the eductor water supply conduit 37. The illustrated arrangement has pipe sections 21 constituted by a length of first tubing 43 within which is fixed in longitudinal alignment, but off center, an equal length of second tubing 44 of approximately one-half the inside diameter of the first tubing 43, to define the cutting jet water supply portion 40. Partitions 45, 46 extend longitudinally in the annular region between the first and second tubing lengths 43, 44, to connect the outside of the tubing 44 to the inside of the tubing 43 in the fourth and third quadrants (at four o'clock and eight o'clock positions) of the tubing 43, as viewed in FIGS. 8–10, to define the slurry retrieval conduit portion 41 in the part of the annular region extending within the first and second quadrants. Where provision is made for an eductor water supply conduit 37, a further partition 47 is angled out from the partition 45 juncture with the outside diameter of tubing 44 to a point on the inside diameter of tubing 43 in the fourth quadrant about 30 degrees clockwise of the partition 45 juncture with the tubing 43 (between the five o'clock and six o'clock positions).

In accordance with the invention, the cutting jet nozzle 30 is mounted on a cutting jet head 50 which is mounted in the lower pipe section 21*a* to be rotatable together with the mining tool 20 about the string axis under control of the swivel 23, but also to be selectively movable vertically independently of movement of the conduit 32 and the remainder of the tool 20 as desired.

For the shown embodiment, see FIGS. 5–7 and 9–10, the cutting jet head 50 comprises a length of vertically extending tubing 51 movably received within the inside diameter of the tubing 44 which defines the cutting jet water supply portion 40 of the lowest pipe section 21*a*. The cross-sectional dimension of tubing 51 is chosen to maximize the internal bore passageway through the tubing 51. A reducer tubing section 52 and a ninety elbow tubing section 53 (FIG. 7) connect the lowermost extreme of the tubing length 51 to the nozzle 30 which is oriented to project transversely, and preferably perpendicularly to the axis of the tubing 51, out through a longitudinal channel 55 (see FIGS. 6 and 10) created in the lowest pipe section 21*a* by partitions 56 and 57 accommodated in the annular portion 58 (FIGS. 8 and 9) of the section 21*a* not used for the conduits 35, 37 and by matching longitudinal slots in the tubing lengths 43 and 44.

The lengths of the channel 55 and of the tubing 51 are chosen to provide the desired vertical maneuverability of the nozzle head 50 relative to the remainder of the tool string 20. A preferred embodiment has the lengths of the channel 55 and tubing 51 chosen so that the tubing 51 will fit entirely within the lowest pipe section 21*a* when the tubing 51 is lowered to its downmost extent of travel within channel 55 and will have its cutting nozzle end below the top of the lowest pipe section 21*a* when it is raised to its upmost extent of travel within channel 55. This is not a necessary requirement, however, and it will be appreciated that the relative lengths of the channel 55, tubing 51 and lowest segment 21*a* can be chosen to suit individual needs. An advantageous feature of the nozzle head 50 is that, unlike the corresponding nozzle carrier in the Archibald '345 patent, the head 50 does not extend for the length of the string 20, but occupies only a bottom portion thereof.

Figure 5:
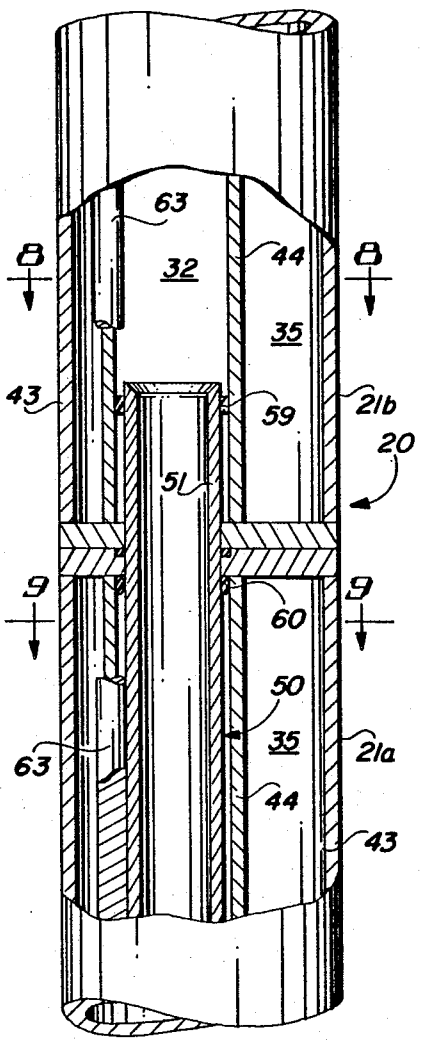
FIG. 5 is a cutaway view, partially in section, of an intermediate portion of the tool string of FIG. 2.

As shown in FIG. 5, a series of seals 59, 60 establishes a watertight sliding connection between the interior, cutting jet water supply portion 40 (FIGS. 8 and 9) defining the conduit 32 of the upper section 21*b* and the exterior of the vertically movable tubing insert 51. This ensures that water delivered from the pump 31, through the hose 26 to the swivel 23 and conduit 32, will be transported into the tubing insert 51 and out through the cutting jet nozzle 30. The seal 60 prevents grit or sand in the created slurry 34 from entering the primary seal area 59 through channel 55 to cause abrasion and subsequent loss of cutting jet water supply delivered to the nozzle 30.

Suitable means for raising and lowering the jet head 50 is illustrated in FIGS. 6, 7, 10, and 11. One preferred arrangement is a lift jack nut 61 having an internally threaded vertical bore 62 through which a vertically oriented rod 63, whose lower portion is externally threaded, is interconnected. The rod 63 extends through the multi-conduit pipe string 20 from the surface of the borehole 10 to the lowest section 21*a* of the tool 20, and is made up of rod sections 64*a*, 64*b* (FIG. 11) which fit within unused portions 65 of the annular regions 58 (see FIGS. 8–10), not occupied by the channel 55, of the respective sections 21 of the main piping 20. In the shown embodiment, the rod 63 is externally threaded at least for a length sufficient to permit threaded engagement with the jack nut 61 for a distance to provide the desired extent of vertical travel for the nozzle 30 relative to the channel 55. If desired, the rod sections 64*a*, 64*b* may be run within a vertical guideway of small diameter tubing fixed in each section 21. Opposing ends of the sections 64*a*, 64*b* are provided with complementary keys 66 and openings 67, or similar end configurations, which can be mated for positive rotational coupling of the sections 64*a*, 64*b* with each other when the pipe sections 21 are brought together, as shown in FIG. 5. The lift jack nut 61 includes a projecting portion 69 which has an upwardly facing opening 70 into which a longitudinal downwardly projecting portion of a lifting lug 71 attached to the reducer section 52 may be brought and secured thereto by means of laterally extending bolt fastener 72 passing through a transversely disposed opening 73.

The interconnected rod sections 64 form a long screw that is selectively rotatable from the surface by means of a cutting jet elevating motor 74 (FIG. 4) mounted on the swivel 23 with its output shaft connected to the rod 63 through a gear coupling 75. As the rod 63 is turned from the surface by the shaft of the motor 74, the lift jack nut 61 attached to the nozzle head 50 by means of the lifting lug 71 will be raised or lowered. The motor 74 may suitably be a reversible electric motor mounted on top of the main swivel 23 with slip rings or similar known electrical connection to a suitable power source. The direction of rotation of the motor 74 will determine the vertical direction of movement of the nozzle 30 within the channel 55.

It will be appreciated by those skilled in the art to which the invention relates that other means also may be employed for lifting the cutting head 50, such as by providing a separate hoist as in Archibald, however connected to raise and lower only a small diameter element such as rod 63, without raising or lowering upper sections of the cutting jet water supply conduit 34. This can, for example, be done by modifying the shown embodiment to provide a fixed connection between the rod 63 and the lifting lug 71, and using a separate hoist to raise and lower the upper end of the rod 63 rather than rotate it.

In a suitable implementation of the depicted embodiment, each section 21 of the tool 20 may be comprised of 100 ft. lengths of tubing 43 of 12 in. diameter pipe. The tubing 44 may be constituted by a similar 100 ft. length of 6 in. pipe and the insert tubing 51 which carries the nozzle 30 may be constituted by a lower 30 ft. length of 5 in. pipe to give an approximate 30 ft. of independent vertical movement of the nozzle 30. At the lowermost point of the tubing 51 (see FIGS. 6 and 7), a 5 in. ×3 in. reducer 52 can be provided leading to a 90 degree 3 in. elbow 53 followed by the nozzle piece 30. In contrast to the Archibald system in which a separate pipe extending all the way from the surface is connected to a cutting jet nozzle, the present invention provides a tubing run 51 for the nozzle 30 which is only located in the lower section 21*a* of the tool string 20 and which is raised and lowered by independent means (viz. rod 63) manipulated from the surface but which has a very small dimension and does not interfere with the dimensioning of, or require lifting of, the conduit 32

The improved efficiency of the present system compared to the system proposed by Archibald is apparent from the following comparative example:

It is known that the energy to move water through a pipeline is greatly increased when the cross-sectional area is reduced. If, considering the movable surface-to-downhole pipeline system of the Archibald patent it is desirable to move 1,000 gallons per minute (GPM) through a 2.2 in. diameter pipeline and have a pressure drop available at the nozzle of 500 pounds per square inch (PSI), then each 100 ft. of pipeline length will have a friction loss of 860 ft. of head or 370 PSI. If the cutting jet is required to operate at a nominal depth of 250 ft., then the pressure required at the pump discharge would be 2.5×370 PSI plus 500 PSI=1.425 PSI. Thus the energy required to produce 1,000 GPM at 1,425 PSI would be in the range of 1,200 brake horsepower, assuming a pump efficiency of 70%.

If a fixed pipeline system in accordance with the foregoing embodiment of the present invention were used, instead, with only the lower 30 ft. section of insert tubing 51 movable within the cutting jet conduit pipeline 44 of 6 in. inside diameter, and still requiring 1,000 GPM and 500 PSI drop, the pressure required at the pump discharge would be 6.1 ft. of head or 2.64 PSI loss per 100 ft., or 5.8 PSI for 220 ft. Assuming that the lower section insert tubing 51 were 30 ft. long and were only 5 in. in diameter, then 7.0 PSI for 100 ft. of length or 2.1 PSI for 30 ft. would be lost in the insert 51. Discounting losses from bends, restrictions, etc., that would affect both cases, then the minimum required PSI for this system would be 508 PSI. The energy required to produce 1,000 GPM at 508 PSI would be in the range of only 430 brake horsepower (compared with Archibald's 1,200 brake horsepower), assuming the same 70% pump efficiency: A much more efficient system!

As can be seen from the foregoing example, a fixed single pipeline with only a lowest portion 51 movable is a far more efficient means of transporting water to the nozzle 30 than a separate movable pipeline as in Archibald which extends all the way through the mining tool string from the surface to the nozzle. The purpose of this water is to provide energy at the face of the material to be slurried. By only requiring the movement of the lower 30 ft. (more or less) of cutting jet conduit pipe and nozzle, this energy can be delivered efficiently while still retaining the desired independent vertical movement of the nozzle.

The novel slurry elevation aspect of the present invention is now discussed.

The annulus 80 (see FIGS. 2 and 4) of the borehole 10 between the casing 14 and outside diameter of the mining tool 20 is advantageously filled with water to perform the mining in a flooded system. In prior art systems utilizing an eductor, the flooded environment provides a hydrostatic head due to the depth of water between the slurry intake port 39 and the level of natural water table that increases the efficiency of the eductor. In accordance with the invention, the outer casing is sealed to prevent the pressure generated in the downhole cavity from being lost outside the casing. Also at the surface of the hole 10, the casing 14 is connected in sealed manner to the stationary bottom of the rotating swivel 23 and a pipe 81 is provided to connect the annulus 80 to the inside chamber of a vertical standpipe container 82, as illustrated. This seal will force the water and or solids of the slurry 34 resulting from the action of the cutting jet stream 33 to take the path of least resistance in leaving the borehole cavity. Two paths are available for this material. One of these is at the bottom of the cavity, at which area the highest percentage of slurry solids is expected and where the slurry intake port, collection point 36 is located. The other outlet is at the overflow line 81 leading from the sealed annulus 80 at the top of the borehole 10, where the percentage of solids in the slurry 34 is the lowest.

The standpipe 82 is arranged so that the highest elevation of its inside channel is enough above the level of the slurry line 27 at the surface so that the excess water emitted from the cutting jet 30 will cause the level of the slurry 34 to rise to a level of equilibrium in the standpipe 82. The elevation differential will be sufficient to overcome the density difference in the slurry 34 plus the friction losses resulting from the movement of slurry 34 up the slurry retrieval conduit 35. The slurry 34 can thus be elevated to the surface without the necessity for a downhole pump. To assist slurry recovery through the conduit 35, the slurry discharge hose line 27 from the swivel 23 is connected to the suction port of a surface-located slurry pump 83 to provide suction lift. This will contribute to reducing the physical elevation difference necessary to perform an eductorless slurry lift function. Sealing the top of the casing 14 except at the annular overflow line 81 and directing that overflow to the standpipe 82 provides a sufficient hydrostatic head to force the slurry at the bottom of the borehole 10 into the intake 36 and u the slurry conduit 35 of the mining tool 20.

Figures 3, 11:
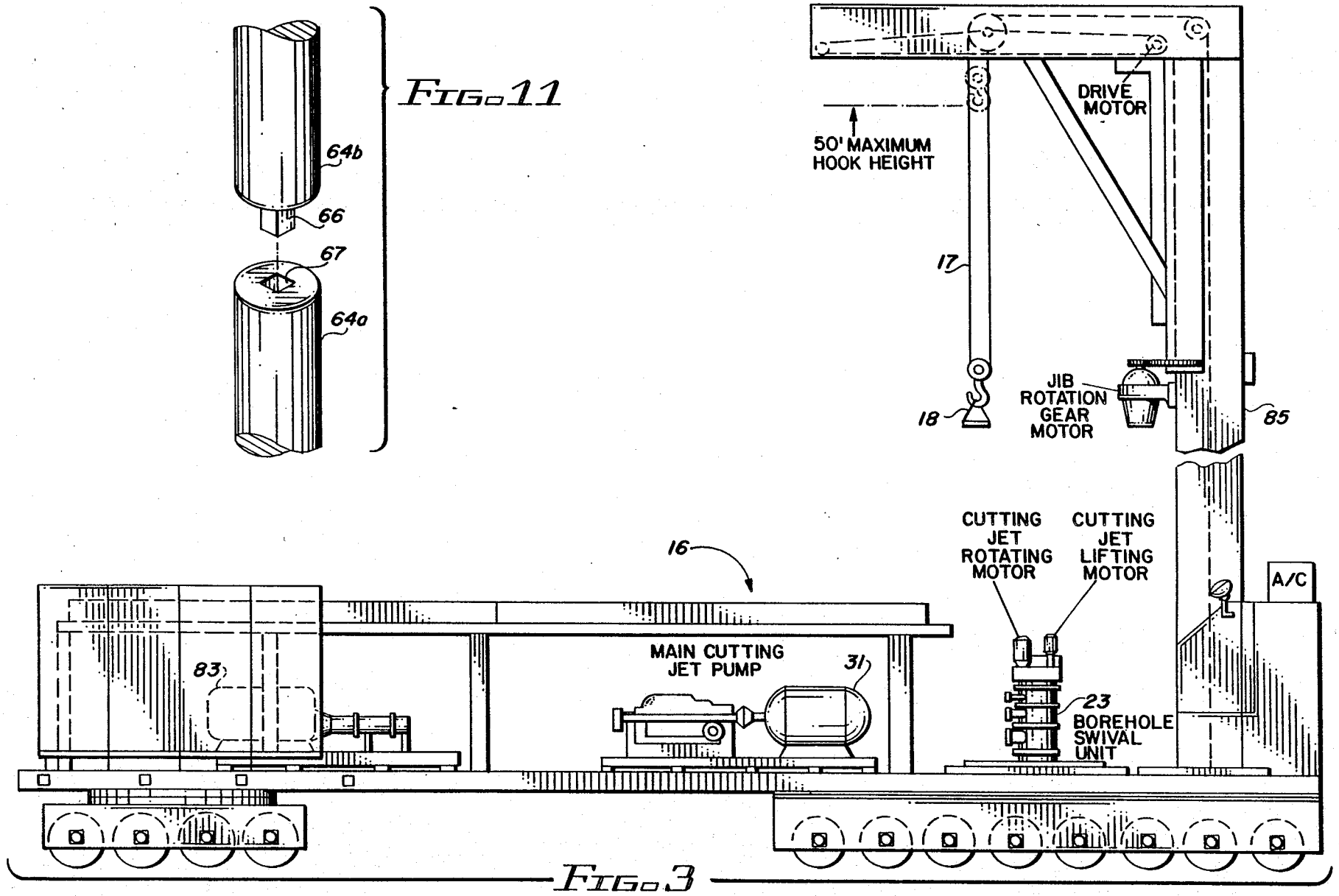
FIG. 3 is a side elevation view of a platform suitable to provide the surface components of FIG. 2.
FIG. 11, an enlarged, fragmentary perspective view showing the manner of joinder of adjacent sections of the threaded rod of FIG. 5.

For space conservation, the cavity of the standpipe 82 may, if desired, be integrated within the mast 85 of the hoist 17 (see FIG. 3). This can be done by having the mast 85 have a lower hollowed-out portion into which the annulus 80 overflow can discharge.

One advantage of the above piping set-up and of the surface slurry pump 83 connection as described is that the system can be reversed after mining, with the same string 20 left in the hole, so that the processed waste material resulting from treatment of the initial recovery can be thickened after useful ore extraction and pumped back into the bottom of the cavity through the same slurry conduit 35, for the backfilling step illustrated in FIG. 1C. The low solids water displaced out of the top of the cavity by this pumping action can be passed through the standpipe 82 at a valve 86 (FIGS. 2 and 4) to a discharge or recovery point 101. The capability to perform this function is especially useful if it is desirable to backfill a lower excavated cavity to maintain its stability while mining a higher region. In addition, if a mineral zone 12 is thicker than the length of the movable nozzle section, the entire mineral zone 12 can be recovered by alternately mining and backfilling, starting from the bottom and moving to the top of the mineral section 12. Maintaining the lowest part of the mining pipe 20 in waste material will help overcome the reactive forces created by the horizontal nozzle discharge energy that will cause a deflection in a freestanding mining tool during rotation of upper parts. Conventional methods of backfilling which utilize an eductor system cannot simply reverse the flow of material.

The surface platform 16 illustrated in FIG. 3 contains a high pressure water pump 31. The discharge of this pump may be divided so that a portion of the total flow can be diverted to the hose 25 (FIG. 4) through the optional separate conduit 37 (FIGS. 8–10) in the main mining pipe sections 21 to provide eductor pump water to assist in raising the slurry 34, if desired. This function will be useful, for instance, especially if the sealing of the casing 14 is ineffective for some reason and the pressure to maintain the column of water in the standpipe 82 is not available. This option will also prevent the premature abandonment of a cavity 10 if the seal is lost during the mining operation. Some of the advantages of the standpipe 82 arrangement can be realized even if an eductor is used as a primary means for raising the slurry, the increased hydrostatic head serving to make the eductor process more efficient. However, utilizing an eductor pump to raise the slurry continuously will dilute the percentage of solids of that slurry and therefore reduce the hourly production rate of the system. Use of the eductor as an optional backup, though, is suggested.

The foregoing detailed descriptions illustrates a borehole mining operation that may be used to mine deep sedimentary deposits such as phosphates, clay, tar sand, coal, uranium sands, and the like. A principal objective is to make the slurry mining and retrieval process more efficient and productive, and to minimize the down time between holes so that the actual operating factor for each individual mine is as high as possible.

In mining materials such as tar sand or acid soluble materials where scrubbing or leaching action creates a low density material suspended in an aqueous phase or solution, it may be desirable to recover the valuable constituent through the annular region 80 after partial enlargement of the lower portion of the borehole cavity, rather than to continue to recover the same through the slurry retrieval conduit 35. In such case, valve 86 (shown in FIGS. 2 and 4) can be employed to selectively divert the overflow through standpipe 82 to a recovery point 101 for subsequent processing.

As described, in certain instances it may be appropriate to inject waste material through the same tool string used for mining, rather than to perform this function by pulling the mining string and inserting a different backfilling string into the borehole as is usual in the prior art.

The cost effectiveness in a borehole mining system is also greatly improved if the casing used is removed from a completed hole and recycled to a new hole. The setting of the original casing should be conducted in such manner that an effective seal is obtained that prevents the migration of water resulting from the cutting jet pressure from leaking outside the casing. This seal can be obtained either by an inflatable packer, a concrete plug, or by setting the casing into a clay horizon that will react as an effective seal. The seal must be capable of exceeding the pressure head differential of a column of water in the standpipe 82. This column in the standpipe 82 is used to overcome the friction factor of the slurry movement in the slurry retrieval conduit 35 and the density difference of the slurry when compared to water. As described above, an effective seal when used in combination with the standpipe 82 of the invention, can completely eliminate the need for an eductor pump; except, perhaps, for backup purposes.

Those skilled in the art to which the invention relates will appreciate that the preferred embodiments of the invention described in detail above are just examples of how the invention can be implemented, and that various substitutions and modifications may be made to the same without departing from the spirit and scope of the invention as defined by the claims below.

What is claimed is:

1. A hydraulic borehole mining process for the extraction of minerals from a target zone of an underground formation, comprising the steps of:

drilling a borehole from the surface to said target zone;

lowering a cutting jet head by means of a string of multi-conduit pipe sections from the surface through said borehole to a downhole position adjacent said target zone;

delivering a high pressure flow of liquid from the surface through a first conduit of said pipe string to said head and directing the same through a nozzle on said head with sufficient force against said formation to separate particles of material from said target zone to create a slurry of said liquid and material;

retrieving said slurry from said downhole position through a second conduit of said pipe string to the surface; and vertically repositioning said nozzle within said borehole to a different position adjacent said target zone by selectively manipulating said head remotely from the surface through said pipe string, independently of vertical movement of said first conduit and the rest of said string.

2. A process as in claim 1, wherein said vertical repositioning step comprises repositioning said nozzle by moving said head vertically within a lower portion of said first conduit.

3. A process as in claim 2, wherein said vertical repositioning step comprises repositioning said nozzle by selectively moving said head vertically within said first conduit by means of a rod located outside of said first conduit and extending from the surface through said pipe string to said head.

4. A process as in claim 3, wherein said vertical repositioning step comprises moving said head vertically within said first conduit by rotating said rod at said surface.

5. A process as in claim 4, wherein said process further comprises the step of hanging said pipe string from a swivel located at the surface for selective rotation of said nozzle within said borehole by rotating said pipe string with said swivel.

6. A process as in claim 5, wherein said process further comprises the steps of sealing an annulus defined between walls of said borehole and said pipe string; and connecting said sealed annulus at said surface to a vessel having a cavity located above the elevation of the discharge of said slurry from said second cavity at the surface, so that said slurry will rise within said annulus and cavity to create a hydrostatic head pressure in said annulus at said downhole position which will act to raise said slurry to the surface through said second conduit.

7. A process as in claim 6, wherein said sealing and connecting steps act to create a hydrostatic head pressure sufficient to overcome the hydrostatic head pressure differential between said surface discharge elevation and said downhole position plus the friction loss of said slurry traveling through said second conduit.

8. A process as in claim 1, further comprising the step of pumping backfill material from the surface through said second conduit into said borehole.

9. Hydraulic borehole mining apparatus for the extraction of minerals through a borehole from a target zone of an underground formation, comprising:

upper and lower multi-conduit pipe sections connected in end-to-end alignment to form a pipe string having first and second conduits extending from the surface through said borehole to a downhole position adjacent said target zone;

a cutting jet head, including a nozzle, movably mounted within said lower section;

means connecting said first conduit of said connected pipe sections for delivering a high pressure flow of liquid from the surface through said pipe string and directing the same through said nozzle with sufficient force against said formation to separate particles of material from said target zone to create a slurry of said liquid and material;

means connecting said second conduit of said connected pipe sections for retrieving said slurry from said downhole position through said pipe string to the surface; and means for selectively manipulating said head remotely from the surface through said pipe string, independently of vertical movement of said first conduit and the rest of said string, for vertically repositioning said nozzle within said borehole to a different position adjacent said target zone.

10. Apparatus as in claim 9, wherein said cutting jet head is movably mounted within said first conduit of said lower section, and said means for selectively manipulating said head comprises means for moving said head vertically within said first conduit.

11. Apparatus as in claim 10, wherein said means for selectively manipulating said head further comprises a rod extending outside of said first conduit from the surface through said pipe string; and means connecting a lower portion of said rod to said head.

12. Apparatus as in claim 11, wherein said rod comprises upper and lower joined rod sections respectively located in said upper and lower pipe sections, said lower rod section having an externally threaded portion; wherein said means connecting said rod to said head comprises a lift jack nut having an internally threaded bore interconnected with said externally threaded portion; and wherein said means for selectively manipulating said head further comprises means located at the surface for selectively rotating said rod to drive said lift jack nut vertically relative to said rod.

13. Apparatus as in claim 12, further comprising swivel means located at the surface for selectively rotating said string together with said head within said borehole.

14. Apparatus as in claim 13, wherein an annulus is defined between walls of said borehole and said pipe string, and wherein said means connecting said second conduit for retrieving said slurry includes means for discharging said slurry from said second conduit at an elevation at the surface; said apparatus further comprising means sealing said annulus, and a vessel located at said surface and having a cavity extending above said elevation and operable to enable said slurry to rise within said annulus and cavity to create a hydrostatic head pressure which will act to raise said slurry to the surface through said second conduit.

15. Apparatus as in claim 14, wherein said vessel is a standpipe, and wherein said apparatus further comprises a pump located at the surface and connected to said slurry discharging means.

16. A hydraulic borehole mining process for the extraction of minerals from a target zone of an underground formation, comprising the steps of:

drilling a borehole from the surface to said target zone;

lowering a cutting jet head by means of a string of multi-conduit pipe sections from the surface through said borehole to a downhole position adjacent said target zone;

delivering a high pressure flow of liquid from the surface through a first conduit of said pipe string to said head and directing the same through a nozzle on said head with sufficient force against said formation to separate particles of material from said target zone to create a slurry of said liquid and material;

sealing an annulus defined between walls of said borehole and said pipe string, and connecting said annulus at the surface to a vessel having a cavity extending above the elevation of a surface discharge line connected to a second conduit of said pipe string extending from said downhole position to the surface; and retrieving said slurry through said second conduit by the assistance of a hydrostatic head pressure created when said slurry rises within said annulus and said cavity which acts to raise said slurry to the surface through said second conduit.

17. A process as in claim 16, wherein said sealing and connecting step acts to create a hydrostatic head pressure sufficient to overcome the hydrostatic head pressure differential between said surface discharge line elevation and said downhole position plus the friction loss of said slurry traveling in said second conduit; and said retrieving step utilizes said hydrostatic head pressure differential to retrieve said slurry to said surface without the action of any downhole pump.

18. A process as in claim 16, further comprising the step of pumping backfill material from the surface through said second conduit into said borehole.

19. Hydraulic borehole mining apparatus for the extraction of minerals through a borehole from a target zone of an underground formation, comprising:

upper and lower multi-conduit pipe sections connected in end-to-end alignment to form a pipe string having first and second conduits extending from the surface through said borehole to a downhole position adjacent said target zone;

a cutting jet head, including a nozzle, movably mounted within said lower section;

means connecting said first conduit of said connected pipe sections for delivering a high pressure flow of liquid from the surface through said pipe string and directing the same through said nozzle with sufficient force against said formation to separate particles of material from said target zone to create a slurry of said liquid and material;

a discharge line connected at said surface to said second conduit;

means sealing an annulus defined between walls of said borehole and said pipe string;

a vessel connected to said annulus at said surface, said vessel having a cavity extending above the elevation of said surface discharge line; an means connecting said second conduit of said connected pipe sections for retrieving said slurry from said downhole position through said pipe string to the surface by the assistance of a hydrostatic head pressure created when said slurry rises within said annulus and said cavity acts to raise said slurry to the surface through said second conduit.

20. Apparatus as in claim 19, wherein said vessel is a standpipe; and wherein said apparatus further comprises a pump located at the surface and connected to the slurry discharge line, said pump being selectively operable to draw said slurry from said second conduit in a first mode of operation and to pump backfill material through said second conduit into said borehole for backfilling said well in a second mode of operation.

* * * * *